US009816721B2

(12) United States Patent
Towsley

(10) Patent No.: US 9,816,721 B2
(45) Date of Patent: Nov. 14, 2017

(54) SYSTEM AND METHOD FOR OPTIMIZING ENERGY CONSUMPTION IN AN HVAC UNIT BY MINIMIZING CHILLER ACTIVITY

(71) Applicant: Jacob Towsley, Portagebille, NY (US)

(72) Inventor: Jacob Towsley, Portagebille, NY (US)

( * ) Notice: Subject to any disclaimer, the term of this patent is extended or adjusted under 35 U.S.C. 154(b) by 646 days.

(21) Appl. No.: 14/296,784

(22) Filed: Jun. 5, 2014

(65) Prior Publication Data

US 2015/0354843 A1 Dec. 10, 2015

(51) Int. Cl.

| | |
|---|---|
| ***F24F 11/00*** | (2006.01) |
| ***F24F 3/08*** | (2006.01) |
| ***F24D 19/10*** | (2006.01) |

(52) U.S. Cl.

CPC ..... *F24F 11/0012* (2013.01); *F24D 19/1084* (2013.01); *F24D 19/1087* (2013.01); *F24F 3/08* (2013.01); *F24F 11/008* (2013.01); *F24F 11/0034* (2013.01); *F24F 2011/0047* (2013.01); *F24F 2011/0082* (2013.01)

(58) Field of Classification Search

None

See application file for complete search history.

(56) References Cited

U.S. PATENT DOCUMENTS

| | | | | |
|---|---|---|---|---|
| 4,337,893 | A * | 7/1982 | Flanders | F24D 12/02 236/1 EB |
| 6,269,650 | B1 * | 8/2001 | Shaw | F24F 11/008 236/44 C |
| 8,374,725 | B1 * | 2/2013 | Ols | F24F 11/0012 261/118 |
| 9,410,752 | B2 * | 8/2016 | Wallace | F28F 27/00 |
| 2004/0117330 | A1 * | 6/2004 | Ehlers | F24F 11/0012 705/412 |
| 2007/0043478 | A1 * | 2/2007 | Ehlers | F24F 11/0012 700/276 |
| 2014/0262134 | A1 * | 9/2014 | Arensmeier | F24F 11/02 165/11.2 |
| 2014/0321839 | A1 * | 10/2014 | Armstrong | F24H 9/2021 392/463 |

* cited by examiner

*Primary Examiner* — Ljiljana Ciric
(74) *Attorney, Agent, or Firm* — Ruben Alcoba, Esq.

(57) ABSTRACT

A system and method that optimizes energy consumption in an HVAC unit by minimizing chiller activity. The system uses a control unit that overrides a thermostat in at least one room to close a cooling valve that leads a fluid input to the room. When multiple cooling valves are closed through the rooms, the consequential return fluid maintains greater cooling capacity and thus, the chiller does not have to operate at full capacity. The control unit individually controls components in the HVAC unit, which were previously controlled by switches on the thermostat. The control unit includes a temperature sensor that monitors an environment, such as the room and a plenum. The control unit also includes a control relay that closes the cooling valve on the HVAC unit when the predetermined temperature of the control unit is above the thermostat temperature set by a room occupant.

10 Claims, 3 Drawing Sheets

SYSTEM AND METHOD FOR OPTIMIZING ENERGY CONSUMPTION IN AN HVAC UNIT BY MINIMIZING CHILLER ACTIVITY

BACKGROUND

It is known that HVAC (heating, ventilation, and air conditioning) is the technology of indoor and vehicular environmental comfort. Typically, air conditioning large buildings, such as hotels requires the use of compressor-based cooling plants. These systems employ multiple machines, and are the most common method of providing cooling for medium and large commercial and institutional buildings and also for many industrial processes. These systems employ a chiller to remove heat from a liquid via a vapor-compression or absorption refrigeration cycle. Chillers are usually electric driven, but may also be driven by an engine or other power source. Electric driven water chillers are used extensively in buildings, campuses and district cooling plants to provide chilled water for comfort conditioning.

Often, the vapor-compression-based systems enable an HVAC unit to reliably chill inside environments well below ambient temperatures. When operated as an air conditioner, the compressor converts the refrigerant from gaseous to liquid form, thereby extracting considerable heat from it. That heat is then transferred to the outside air. The newly chilled liquid is then circulated to the evaporator under high pressure through insulated tubing. Once it reaches the evaporator, which is located inside an air handler in which the air is conditioned by being forced past the evaporator by a fan, the pressure on the liquid is removed, at which point the liquid reconverts into a gas, thereby absorbing heat from the air being blown across the evaporator. The refrigerant is then transported in gaseous form back to the compressor to repeat the cycle. Thus heat is transferred from the air in the conditioned space to the refrigerant, and then from the refrigerant to the outside air.

Typically, individual rooms in a hotel employ thermostats to enable the occupants to adjust the temperature to a desired level. However, this latitude to freely set the temperature is often abused, as the occupant excessively lower the temperature on the thermostat. This creates a large waste of energy, especially for larger buildings, such as hotels. The chiller must work at high power levels to perpetually cool the recirculated fluid from the HVAC system.

The inventor has been working in the field of motor control units for over seven years. The inventor recognized that large users of energy such as hotels, office buildings and the like have found the need to conserve energy is now critical to profitability. Public and non-profit facilities such as schools, universities, hospitals, and civic buildings must divert limited financial resources from their primary missions to pay for energy. Therefore, many energy conservation strategies and devices have been developed over the past several decades. On a smaller scale, individual families are faced with ever-increasing utility bills, sometimes forcing the choice between living needs and paying for electricity, gas, or oil.

The inventor decided to invent a system and method for taking the excessive set point out of the hands of the occupant by overriding the thermostat. The inventor knew that chillers and the pumps that circulate fluid in an HVAC unit are the largest consumers of electricity. He had to enable the return line to return with cooler water so that the chiller would not have to exert maximum energy, and thus consume excessive energy. The inventor decided to override the thermostat in each room, figuring that the cumulative effect of restricting temperatures in each room would lead to large savings over a duration. The inventor initially, manually went into unoccupied rooms and adjusted the thermostat to a more reasonable setting.

However, he realized that a more automated system was needed. After trial and error, the inventor decided to override the thermostat with a bypass feature having a reasonable and comfortable predetermined temperature. However, the room would not be allowed to fall below this predetermined temperature, no matter at which setting the room occupant set the thermostat. The overriding function was done with a control unit that integrated into the HVAC unit.

A temperature sensor in the control unit sensed the temperature in the room, and if the room temperature fell below the predetermined temperature, the temperature sensor would trigger a control relay to shut off a cooling valve going into the room. Repeated over many rooms, the return fluid was cooler since it did not have to work so hard in each room; and thus the chiller did not have to operate at high power to cool the return fluid for reentry into the HVAC units and rooms. The inventor used a wire harness to enable the control unit to be retrofit into a variety of HVAC units—especially older HVAC units with no intelligence.

HVAC optimization systems have been used for reducing energy consumption in cooling and heating systems in the past, yet none with the present characteristics of the present invention. See Patent numbers: U.S. Pat. No. 8,457,802; U.S. Pat. No. 7,878,236; and U.S. Pat. No. 8,511,576.

For the foregoing reasons, there is a need for a system that optimizes energy consumption in an HVAC unit by minimizing chiller activity with a control unit that overrides a thermostat in a room.

SUMMARY

The present invention describes a system that optimizes energy consumption in an HVAC unit by minimizing chiller activity. The system uses a control unit that overrides a thermostat in at least one room to close a cooling valve that leads a fluid input to the room. When multiple cooling valves are closed through the rooms, the consequential return fluid maintains greater cooling capacity and thus, the chiller does not have to operate at full capacity.

The control unit individually controls components in the HVAC unit, which were previously controlled by switches on the thermostat. The control unit is a standalone retrofit control unit that is installed into the room to override the thermostat. In some embodiments, the control unit includes a temperature sensor that monitors an environment, such as the room and a plenum. The control unit includes a control relay that controls the cooling valve on the HVAC unit. The control relay closes the cooling valve at a predetermined temperature that is above a thermostat temperature set by a room occupant. The predetermined temperature is determined by the temperature sensor, which triggers the control relay to shut the cooling valve accordingly. In this manner, the room can be maintained at a reasonable temperature without operating at an excessively low set point by the thermostat temperature.

One objective of the present invention is to save energy for cooling systems.

Another objective is to easily add control to HVAC units in room monitoring systems.

Yet another objective is to updated outdated HVAC units with intelligent temperature control.

Yet another objective is to easily retrofit a control unit on standard HVAC units.

Yet another objective is to minimize activity of chillers and pumps by minimizing the temperature of return fluid to the chiller.

Another objective is to buffer the effects of occupants who excessively reduce the set point for the thermostat temperature.

Another objective is to provide various parameters to the control unit so that a variety of HVAC units can be retrofit.

Another objective is to vary the volume of air entering the room with a variable frequency drive that integrates into the control unit.

Another objective is to produce a cost effective control unit.

DRAWINGS

These and other features, aspects, and advantages of the present invention will become better understood with regard to the following description, appended claims, and drawings where:

DESCRIPTION

Figure 1:
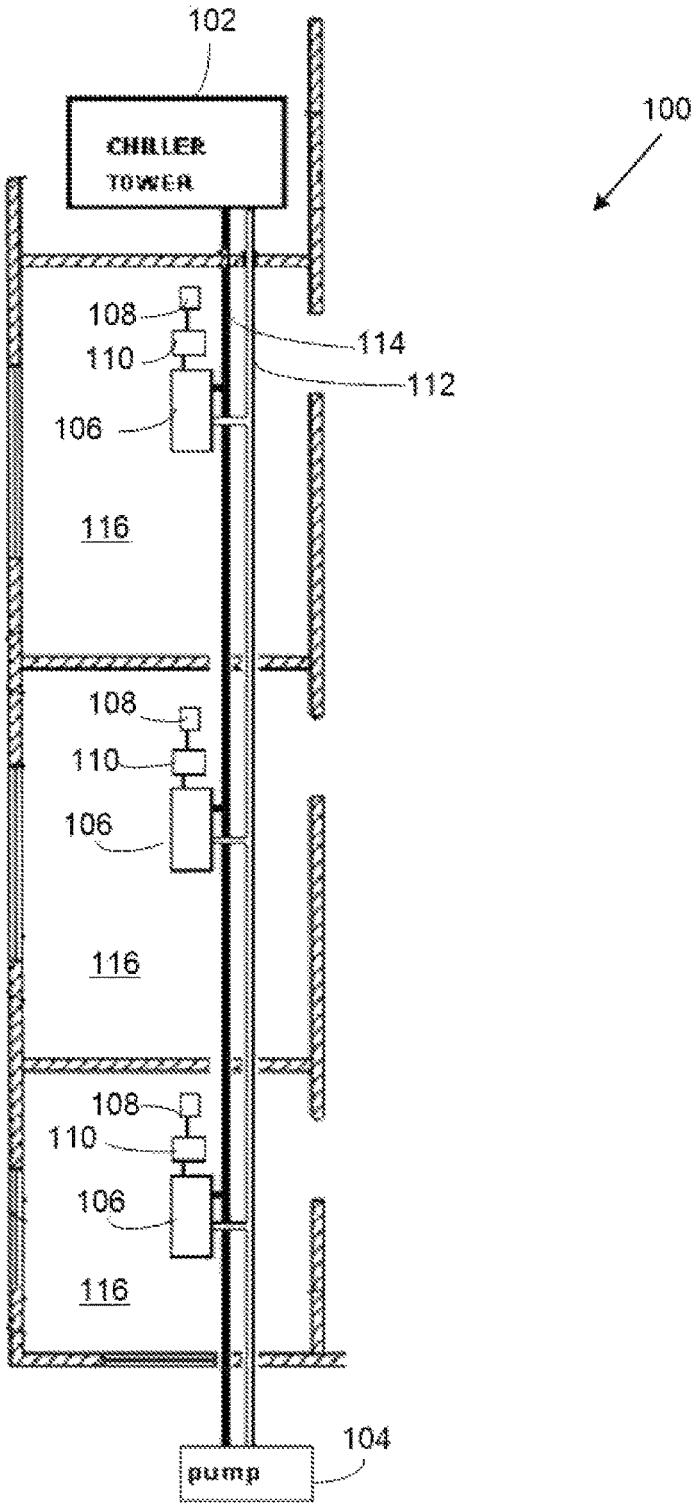
FIG. 1 is a block diagram of a system that optimizes energy consumption in an HVAC unit by minimizing activity of a chiller, showing rooms in a hotel receiving a cool fluid from a chiller through a input line and return line.
Figure 2:
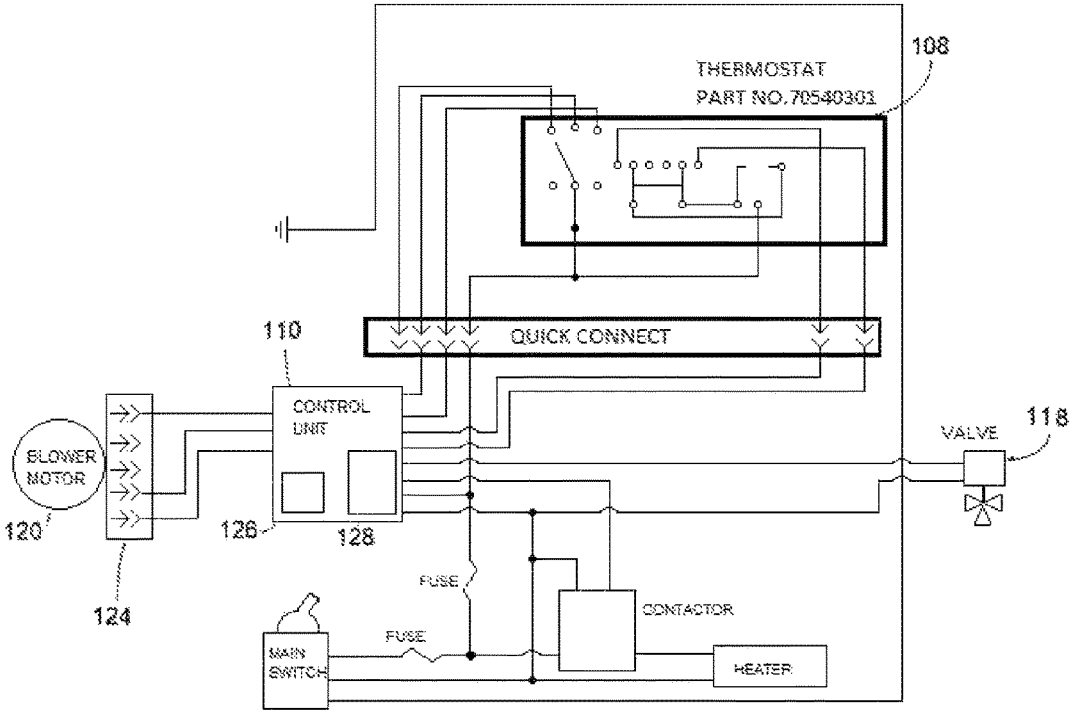
FIG. 2 is a top view of an HVAC unit having a retrofit control unit.
Figure 3:
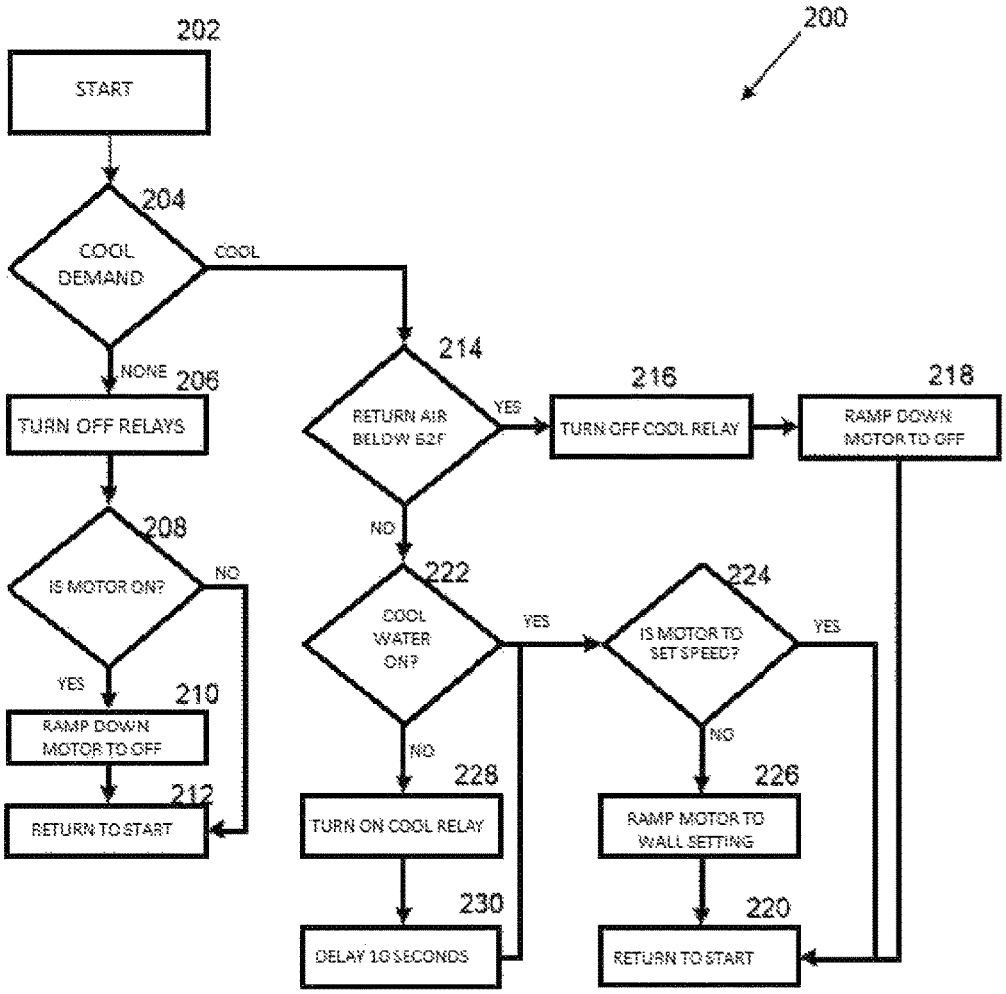
FIG. 3 is a flowchart diagram of a method that optimizes energy consumption in an HVAC unit by minimizing activity of a chiller.

One embodiment, referenced in FIGS. 1-3, illustrates a system 100 that optimizes energy consumption in an HVAC unit 106 by minimizing activity of a chiller 102 that feeds cool air to at least one room 116. Those skilled in the art will recognize that the chiller 102 removes heat from a circulating fluid through vapor-compression or absorption refrigeration cycle. These cooling processes consume large amounts of energy. The present invention retrofits a control unit 110 in the room 116 to override a thermostat 108. The thermostat 108 may have a thermostat temperature set by a room occupant. The control unit 110 overrides the thermostat temperature with a predetermined temperature when the thermostat temperature is above the predetermined temperature. When the predetermined temperature is above the thermostat temperature the control unit 110 closes a cooling valve 118 leading from a fluid input line 112 to the room 116. This enables the fluid to maintain a lower temperature, which consequently reduces the work load on the chiller 102 as it receives the circulated fluid from a return line 114.

FIG. 1 illustrates three rooms 116 arranged in series, such as those rooms found in a hotel. An input line 112 carries cool fluid to an HVAC unit 106 in each room 116. After the cool fluid has absorbed thermal energy from the room 116, and thus cooled the room 116, a return line 114 returns the fluid to a chiller 102 to recool the fluid for recirculation through vapor-compression or by following an absorption refrigeration cycle. A pump 104 forces the circulation through the rooms 116 and back to the chiller 102. In some embodiments, a thermostat 108 in the room 116 has been set to a thermostat temperature by a room occupant. Those skilled in the art will recognize that the thermostat temperature is often left at an excessively low set point, thus increasing energy costs unnecessarily.

The present invention uses a retrofit control unit 110 to override the thermostat 108 in each room 116, and set a predetermined temperature that overrides the thermostat temperature. The control unit 110 can be integrated into the HVAC unit 106 with minimal effort and expense, substantially providing a plug and play device that can be used in a wide variety of HVAC units 106—especially older HVAC units that don't have intelligence. In this manner, the activity of the chiller 102 and the pump 104 can be minimized by maintaining the temperature of the fluid in the return line 114 at a lower temperature, since the fluid did not have to excessively absorb thermal energy from each the room 116.

As referenced in FIG. 2, the system 100 uses a control unit 110 that overrides a thermostat 108 in at least one room 116 to close a cooling valve 118 to the room 116. When multiple cooling valves 118 are closed through multiple rooms 116, the consequential return fluid maintains greater cooling capacity and thus, the chiller 102 does not have to operate at full capacity. The control unit 110 individually controls components in the HVAC unit 106, which were previously controlled by switches on the thermostat 108. The control unit 110 is a standalone retrofit control unit 110 that is installed into the room 116 to override the thermostat 108. A wire harness may position between the control unit 110 and the HVAC unit 106 to facilitate retrofitting. In some embodiments, various parameters can be added to the control unit 110 so that a variety of HVAC units 106 can be retrofit.

In some embodiments, the control unit 110 includes a temperature sensor 126 that monitors an environment, such as the room 116 and a plenum. The control unit 110 may further include at least one control relay 128 that controls the cooling valve 118 on the HVAC unit 106. The at least one control relay 128 closes the cooling valve 118 at a predetermined temperature that is above a thermostat temperature set by a room 116 occupant. In another embodiment, the at least one control relay 128 closes a heating valve at a predetermined temperature that is below a thermostat temperature. The predetermined temperature is determined by the temperature sensor 126, which triggers the control relay 128 to shut the cooling valve 118 accordingly. In this manner, the room 116 can be maintained at a reasonable temperature without operating at an excessively low set point by the thermostat temperature. In one embodiment, the predetermined temperature is between sixty and sixty-four degrees Fahrenheit. In another embodiment, the thermostat temperature is between fifty-two and eighty degrees Fahrenheit.

In some embodiments, the control unit 110 operatively connects to a motor 120 in the HVAC unit 106 through a connector 124, such as a MOLEX connector. However, any two-piece pin and socket interconnection could be used in other embodiments. The control of the motor 120 enables the HVAC unit 106 to regulate the flow of fluid in the room 116 and during circulation between the chiller 102 and the HVAC units 106. Additionally, the control unit 110 has a variable speed motor control that controls an air volume that enters each room 116. The control unit 110 follows thorough specification. In one embodiment, the control unit 110 specs are as follows:

Voltage: 277 vac rms input
Power Rating: 150 W Maximum input
Variable voltage 0-277 vac volts Output
Current Rating: 0.5 Amps Maximum Output
Power Rating for Motor 120/control electronics: 138 W Output Maximum
Environmental Requirements:

Minimum Temperature −25 C
Maximum Temperature 75 C
Relative Humidity 5%-95% Non-Condensing
Shock and Vibration Test:
Temperature: 20° Celcius+−3°
Humidity 60%+−5% RH Non Condensing
Vibration Test IEC 60068-2-6:
Frequency Range 10-150 Hz, 10 $m/s^2$, 3 axes
Sweep rate 1 octave/minute, 1 sweep/axis (1.0 g)

In one alternative embodiment, a monitoring system (not shown) coordinates with the control unit 110 to indicate whether the room 116 is occupied. The occupancy of the room 116 may then be factored into the controller regulation of temperature. For example, an unoccupied room 116 detected by the monitoring system 100 triggers the control unit 110 to default to centralized system 100 parameters.

FIG. 3 illustrates a flowchart diagram of a method 200 that optimizes energy consumption in an HVAC unit 106 by minimizing chiller 102 activity. The method 200 uses a control unit 110 to override a thermostat 108 in at least one room 116. The method 200 includes an initial Step 202 of starting the method 200. The method 200 optimizes energy consumption in an HVAC unit 106 by minimizing activity of a chiller 102 that feeds cool air to the room 116. This can be done by powering on the HVAC unit 106 and pumping fluid through the input line 112 and the return line 114, via the chiller 102. A Step 204 comprises deciding if there is cooling demand. The room 116 occupant may have set the thermostat 108 at a thermostat temperature that is excessively low, and thus wasteful. Generally, if there is no cooling demand, the method 200 is not employed.

In some embodiments, a Step 206 requires that if no cooling demand, turning off at least one control relay 128. This is done by the control unit 110, which overrides the thermostat 108 in the room 116. The method 200 may then move to a Step 208 of deciding if a motor 120 is running. A Step 210 includes requiring that if the motor 120 is running, ramping down the motor 120 to off. The ramping down effect may be effective in reducing stress on the components and reducing energy loss. A Step 212 comprises requiring that if the motor 120 is not running, returning to the Step 202 of starting the method 200. A Step 214 may include requiring that if there is a cooling demand, deciding if a thermostat temperature is below a predetermined temperature.

In some embodiments, a Step 216 may include deciding that if the thermostat temperature is below the predetermined temperature, turning off the at least one control relay 128. The method 200 may then move to a Step 218 ramping down the motor 120 to off. A Step 220 comprises returning to the step of starting the method 200. A Step 222 includes requiring that if the thermostat temperature is not below the predetermined temperature, deciding if an input line 112 is open. A Step 224 may include requiring that if the input line 112 is open, deciding if the motor 120 is at a set speed. Consequently, if the motor 120 is at a set speed, returning to the Step 202 of starting the method 200. In some embodiments, a Step 226 may include requiring that if the motor 120 is not at a set speed, ramping the motor 120 to a wall setting. The method 200 may then move to a Step 228 requiring that if the input line 112 is not on, turning on the at least one control relay 228. A Step 230 comprises delaying ten seconds before powering on the motor 120. The method 200 may then continue to Step 224 to decide if the motor 120 is set to speed, and continue as deemed appropriate.

While the inventor's above description contains many specificities, these should not be construed as limitations on the scope, but rather as an exemplification of several preferred embodiments thereof. Many other variations are possible. For example, the voltage or current input/output of the control unit may vary without affecting the objective of the system. Accordingly, the scope should be determined not by the embodiments illustrated, but by the appended claims and their legal equivalents.

What is claimed is:

1. A system that optimizes energy consumption in an HVAC unit by minimizing chiller activity that uses a control unit to override a thermostat in at least one room, the system comprises:

at least one control unit that retrofits into at least one room, each control unit having a temperature sensor that monitors an environment to ensure that the at least one room is maintained within a range of a predetermined temperature; and at least one control relay that controls a cooling valve, each control relay is a part of the control unit and at least one control relay closes the cooling valve at the predetermined temperature that is above a manually set thermostat temperature.

2. The system of claim 1, comprising a monitoring system that operatively connects to the control unit, the monitoring system overrides a local thermostat control that is based on an occupancy of each room.

3. The system of claim 2, wherein at least one of the control relays closes a heating valve at the predetermined temperature that is below the thermostat temperature.

4. The system of claim 1, wherein the predetermined temperature is between the range of at least sixty and at most sixty-four degrees Fahrenheit.

5. The system of claim 1, wherein the thermostat temperature is set by an occupant in each room.

6. The system of claim 1, wherein the thermostat temperature is between the range of at least fifty-two and at most eighty degrees Fahrenheit.

7. The system of claim 1, comprising a wire harness that is positioned between the control unit and the HVAC unit, thereby facilitating the retrofitting of the control unit.

8. The system of claim 1, wherein at least one of the control relays closes a heating valve at the predetermined temperature that is below the thermostat temperature.

9. The system of claim 1, wherein the control unit has at least two temperature sensors.

10. The system of claim 1, wherein the control unit has a variable speed motor control that controls an air volume that enters each room.

* * * * *